US008281928B2

(12) United States Patent
Smith

(10) Patent No.: US 8,281,928 B2
(45) Date of Patent: Oct. 9, 2012

(54) INFLATABLE BOX

(76) Inventor: Jack V. Smith, Arden, NC (US)

( * ) Notice: Subject to any disclaimer, the term of this patent is extended or adjusted under 35 U.S.C. 154(b) by 0 days.

(21) Appl. No.: 09/898,958

(22) Filed: Jul. 3, 2001

(65) Prior Publication Data

US 2003/0006162 A1 Jan. 9, 2003

(51) Int. Cl.
*B65D 81/03* (2006.01)

(52) U.S. Cl. ..... 206/522

(58) Field of Classification Search ..... 206/521, 206/522, 591, 592, 524.8, 583, 594; 383/3
See application file for complete search history.

(56) References Cited

U.S. PATENT DOCUMENTS 1,266,482 A * 5/1918 Kamrass ..... 5/654
2,697,229 A * 12/1954 Krueger ..... 450/38
3,514,157 A * 5/1970 Geiser ..... 298/22 R
3,521,743 A * 7/1970 Sposito, Jr. ..... 206/583
3,889,743 A * 6/1975 Presnick ..... 165/46
4,569,082 A * 2/1986 Ainsworth et al. ..... 383/3
4,573,202 A * 2/1986 Lee ..... 383/3
4,586,910 A * 5/1986 Buchanan ..... 446/220
4,640,080 A * 2/1987 Wright ..... 53/449
4,793,123 A * 12/1988 Pharo ..... 53/449
4,905,835 A * 3/1990 Pivert et al. ..... 206/522
4,966,185 A * 10/1990 Schram ..... 137/223
4,969,312 A 11/1990 Pivert
5,396,998 A * 3/1995 Chaisson ..... 206/522
5,397,000 A * 3/1995 Holte et al. ..... 206/545
5,454,407 A * 10/1995 Huza et al. ..... 141/10
5,515,975 A * 5/1996 Jarvis et al. ..... 206/584
5,564,570 A * 10/1996 Jaszai ..... 206/523
5,588,533 A 12/1996 Farison
5,624,035 A * 4/1997 Kim ..... 206/522
5,769,232 A * 6/1998 Cash et al. ..... 206/522
5,901,850 A * 5/1999 Jones et al. ..... 206/522
6,076,677 A 6/2000 Pozzo
6,182,826 B1 * 2/2001 Slepian ..... 206/315.4
6,253,919 B1 * 7/2001 Sperry et al. ..... 206/522
6,305,545 B1 * 10/2001 Morrow ..... 206/522
6,334,534 B1 * 1/2002 Hollingsworth et al. ..... 206/320

* cited by examiner

*Primary Examiner* — Jacob K Ackun
*Assistant Examiner* — Jenine Pagan
(74) *Attorney, Agent, or Firm* — Nilay J. Choksi; Smith & Hopen, P.A.

(57) ABSTRACT

The present invention is an inflatable box which can come in any shape or size and be made up of any rigid material. The box is uniquely designed to allow for a simple one step process using a box with an integrated inflating tube and bottom liner to expand internally by inflation which cushions the article to be shipped 3 dimensionally thus completely protecting the article and removing the need for peanuts, paper or other fillers in boxes used for shipping goods once the box is closed.

5 Claims, 7 Drawing Sheets

INFLATABLE BOX

BACKGROUND OF THE INVENTION

1. Field of the Invention

The present invention is a method which relates to a automated or manual packaging system using an inflatable box of any shape and size. The box is uniquely designed to allow for a simple one step process using a box with an integrated inflating tube and bottom liner to expand internally by inflation which cushions the article to be shipped 3 dimensionally thus completely protecting the article and removing the need for peanuts, paper or other fillers in boxes used for shipping goods once the box is closed increasing the safety of the use of inflatable devices. This would also lighten the weight of the package considerably.

2. Description of the Related Art

The use of different type of packaging for shipping articles is well known. Shipped articles can come in all sizes and shapes. These articles can be fragile or hardy (eg. meaning that the article is considered non-fragile). There are several types and forms of packaging to include peanuts, paper, bubble plastic, foam, etc. All of the packaging materials mentioned can cause waste disposal and recycling issues.

Different attempts at providing an effective inflatable packaging material and or system have been made such as U.S. Pat. Nos. 4,905,835 and 4,969,312 to Pivert which is limited to a rectangular box with inflatable structures that are inserted into the box requiring multiple steps for use from insertion of the inflatable structures to closure of the box. In, addition U.S. Pat. No. 5,588,533 to Farison provides an inflatable cushion through a single inflation valve which is inserted into the box with the article. Another U.S. Pat. No. 6,076,677 to Pozzo is a shipping container and inflatable packaging cushion which is partially filled and then the article is inserted and more steps are required.

While the prior art provides protection to the articles within the art however suffers from certain number of drawbacks.

The inflation, insertion, and closure of the prior art devices all require multiple steps and are not simple efficient method to ship articles or products using an inflatable cushion. The prior art requires a tedious methods for inflation. For instance, the prior requires that certain cushion be inflated before others in a specific sequence, that cushions be inflated before insertion into the box, complex sequence of events for closure of box flaps and/or self locking flaps, they require optimal inflation to work properly and finally require multiple cushions to provide adequate protection to the article shipped. These are just some, not all, of the limitations of the prior art.

SUMMARY OF THE INVENTION

The present invention is designed to advance the art of packaging past the prior arts drawbacks and provide packaging that is simple to use, requires minimal instruction, has the minimum number of parts, and is cost effective. Another object of the present invention is to provide a method that allows for an easily automated process.

Correspondingly, another of the present art is to provide a packaging method that will allow the user to insert the article to be shipped and close the box prior to inflation, this of course has several marked advantages over the prior art. Such as safety, no hazard of the inflatable bladder (air cushion) exploding in the face of the user if overinflated, this can of course be avoided by a bleed valve that will release air when pressure reaches a certain level. This in addition would allow for automated and manual air filling without worry of overinflating.

In addition the present art provide a unique three dimensional cushion which will fully protect the article being shipped which can be filled from a single valve or point.

It has been found that the foregoing objects of the present art are accomplished in accordance with this invention by providing a box that has an inflatable cushion attached to the inside liner of the box which has an collapsible bottom that fill with air like the rest of the cushion (bladder) when the box is closed and the cushion is filled with air. The cushion is designed so that is may be inflated through a single valve or other inflation means that is attached to the outside of the box allowing for inflation of the device after the box is closed. The cushion may also have a bleeder valve installed in the wall of the box that will allow air to escape in the case of over inflation.

Once the bottom of the box is closed the article can be placed into the bottom of the box. The box can then be closed and the air cushion (air bladder) can be filled externally from the valve attached to the wall of the box to a preset amount. A bleeder valve can also be install into wall of the box to prevent overfill. This allows for a fully automated inflatable packaging system.

The present invention provides a method of packaging an article using packaging as defined above, and the method being characterized by the following steps:

a) closing the bottom flaps of the box;

b) placing the article to be shipped into the box;

c) closing the top flaps of the box;

d) filling the box with air through the valve.

Other aspects and advantages of the present invention appear more clearly from reading the following detailed description of the preferred embodiment of the invention, given by way of example and made with reference to the accompanying drawings. Such as the determination of which end of the box is the bottom or top. This is determined by which end of the box is closet to the inflatable bottom part of the cushion. A thorough search of the literature reveals no relative art resembling this technology; therefore, this invention is clearly a novel in creation, and is not obvious to anyone skilled in the art, there are certain aspects of the present art that can be found in the prior art but no prior has advanced the art of inflatable packaging as much as the present art. This art solves an unrecognized problem that was never before even recognized. Specifically this allows for the user the unexpected results of placing an article(s) for shipment into a box, close the box, fill it with air, and ship it. This was never conceived until the present art and advances the art significantly. In fact the prior art as cited teach away from the present art in that it teaches the use of multiple cushions, multiple steps to closure, inflation of cushions (bladders) before closure of the box, etc.

BRIEF DESCRIPTION OF THE DRAWINGS

Other objects, features and advantages of the invention will become obvious from the following detailed description of the invention when taken in conjunction with the accompanying drawings, in which.

DETAILED DESCRIPTION OF THE PREFERRED EMBODIMENTS

The present invention will now be described more fully with reference to the accompanying drawings, in which the preferred embodiments of the present art invention are shown. It is understood from the embodiments that a person skilled in the art may make variations and modifications without departing from the spirit and scope of the invention. Such as changing the size or shape of a box, the optional addition of a bleeder valve, or the addition of a small hand pump integrated into the side wall of the box.

Figure 1:
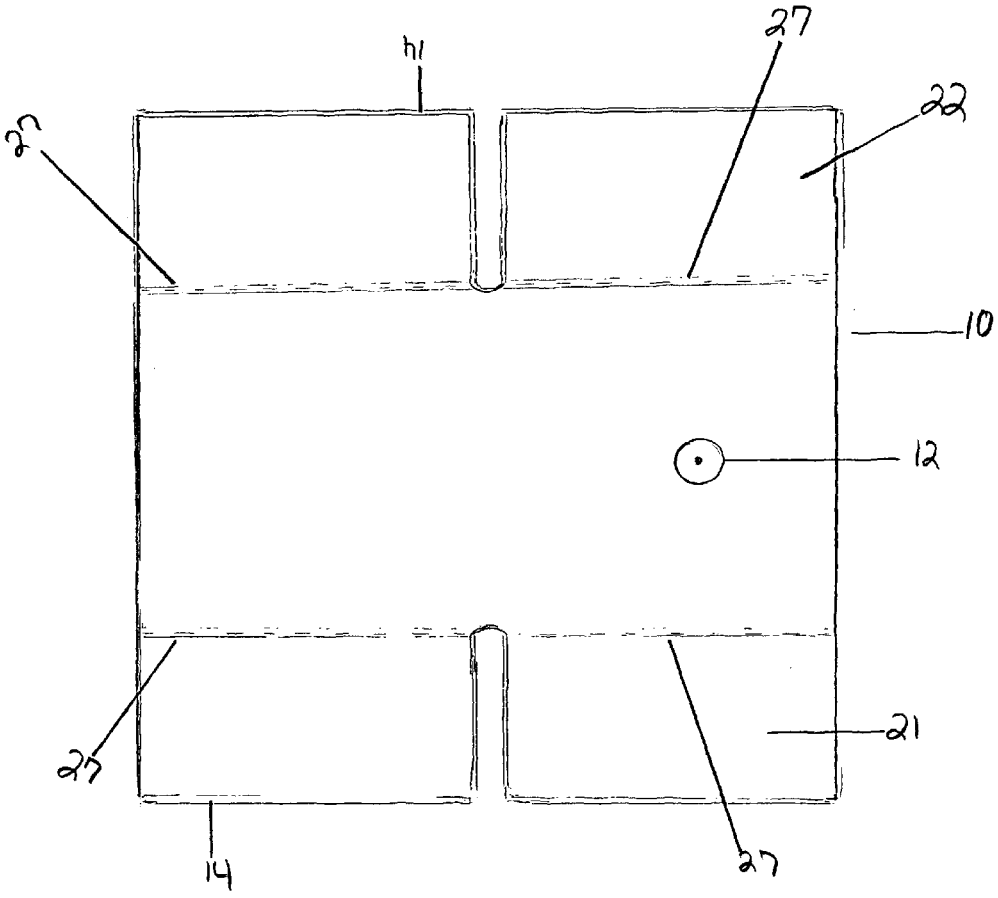
FIG. 1 is a plan view of one embodiment of the inflatable box made in accordance with this invention shown prior to closure of the bottom and inflation.
Figure 2:
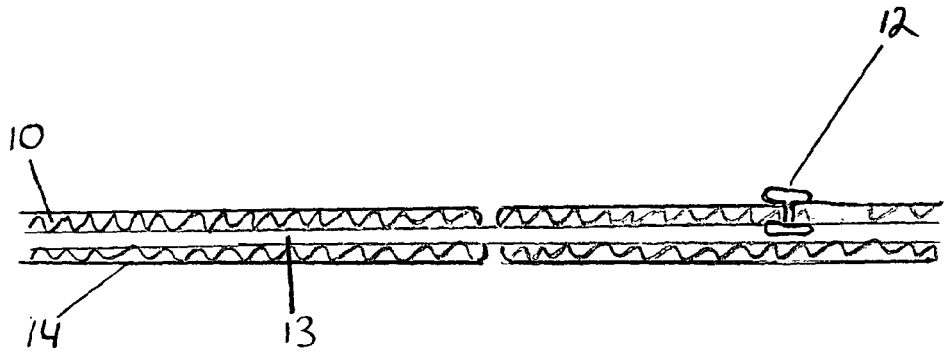
FIG. 2 is a side view of FIG. 1 prior to closure of the bottom flaps and inflation with air.

Referring now to the drawings and in particular FIGS. 1 and 2 the inflatable box 10 as shown is flat and the bottom has not been closed. The plan view of FIG. 1 shows the bottom flaps 21 and top flaps 22 and folds 27 of the bottom and top of the box 10, also illustrated is the air valve 12 which for illustration purposes has a label that states the maximum air pressure allowed is 25 psi. The pressure can vary from 1 psi to as much as 100 psi. The amount of pressure allowed is directly proportional to the strength of the material used in the inflatable air cushion 13 and box 10. Hence, the stronger the materials used the higher the air pressure that can be allowed. This is of course is reference to extreme levels. In most cases, air pressure as little as 10 to 25 psi will usually be more than adequate and a device as simple as a basketball air pump could be used to achieve this pressure. The material used in the inflatable cushion 13 of FIG. 2 can range from rubber to plastic of any types or other suitable material capable of holding air and conforming to the shape of the article(s) shipped in the box 10. The box 10 of FIGS. 1 and 2 can be made of cardboard, paper, plastic, wood, corrugated paper 14, or other suitable materials.

Figure 3:
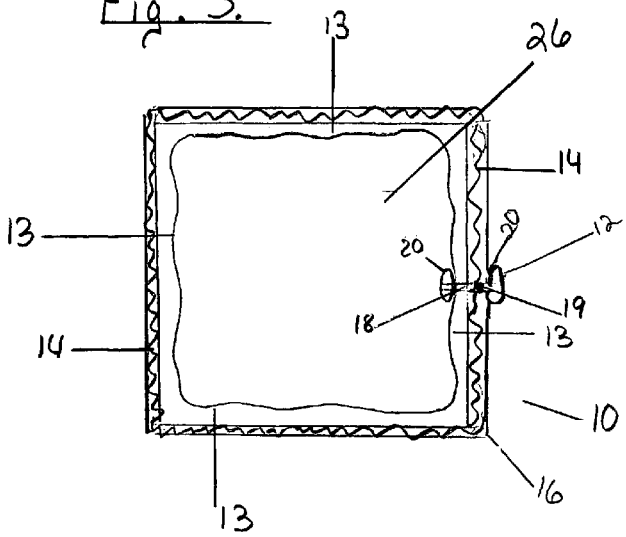
FIG. 3 is a side view of the box in FIG. 1 folded out prior to closing the bottom flaps allowing a view of the transparent bladder bottom at the bottom of the box.
Figure 4:
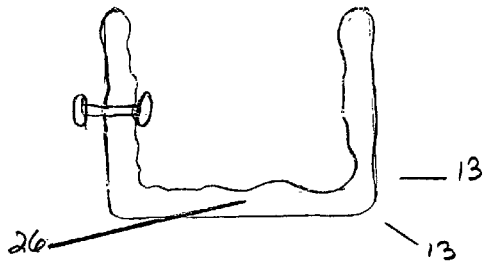
FIG. 4 is a cross sectional side view of the inflatable cushion if it were not attached to the box.
Figure 6:
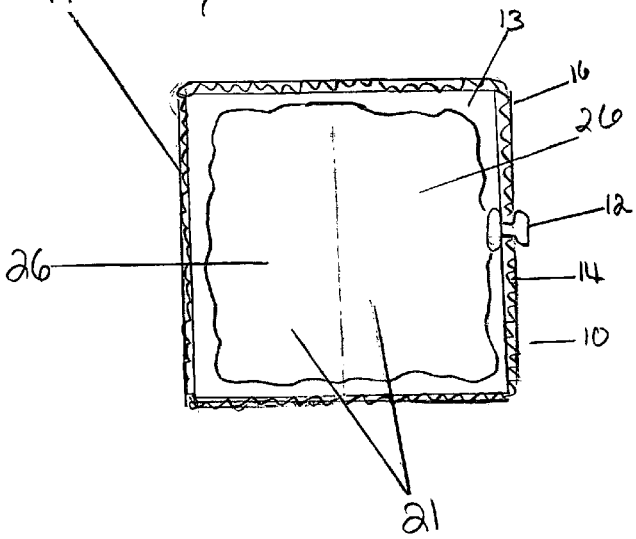
FIG. 6 is a top view of FIG. 3 with the bottom flaps closed.
Figure 5:
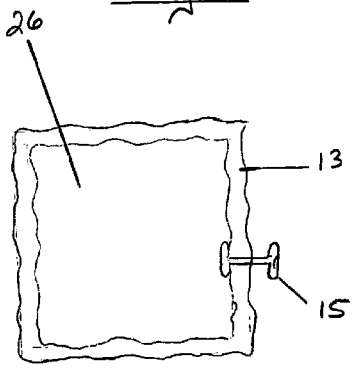
FIG. 5 is a top view of the inflatable cushion if it were not attached to the box.

As shown in FIG. 3, the transparent inflatable cushion (bladder) 13 is attached to the inside 17 of four sides of the box 10 prior to use, by use of an adhesive such as glue, paste, or other suitable material or device. The bottom of the inflatable cushion 26 which can be seen in FIG. 3 is visible. The valve 12 as illustrate in FIG. 3 is in fluid contact with the bladder 13 and the outside of the box 16 via a hollow tube (lumen) 18 connecting the outside of the box 10 and the inside of the inflatable cushion 13. The valve 12 can be held in place using a lip 20 that will hold the valve to the outside 16 of the box 10 and the inside of the inflatable cushion 13. There can be a septum 19 in the middle of the valve that will allow a needle to pass through and seal when the needle is removed. The mechanics and illustration for the valve 12 and how it is connected can be changed without leaving the spirit and scope of the invention. FIG. 4 and FIG. 5 illustrates what the bladder 13 would look like if it were not connected, bonded to, or otherwise attached to the box 10. FIG. 6 shows an inside view of the box 10 with the bottom flaps 21 closed.

Figure 7:
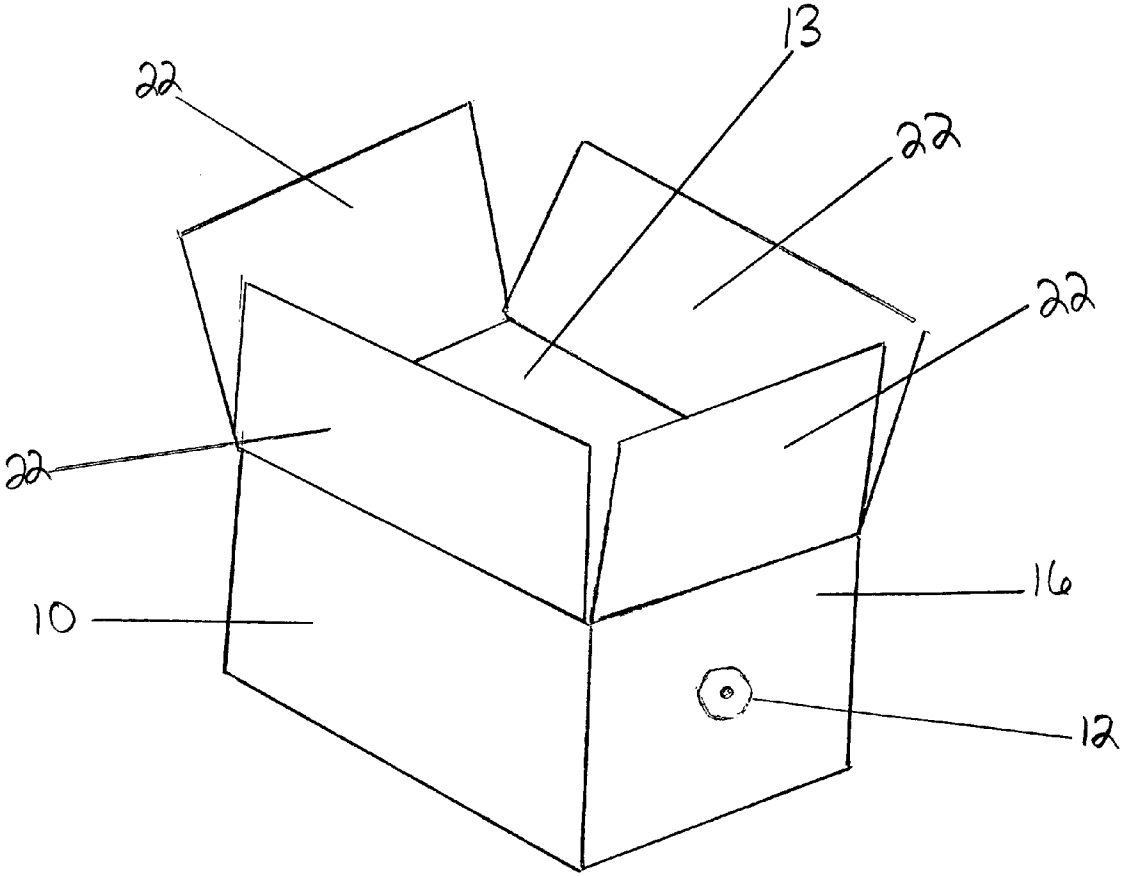
FIG. 7 is a plan view of the box in FIG. 1 with the bottom closed exhibiting the air valve.
Figure 8:
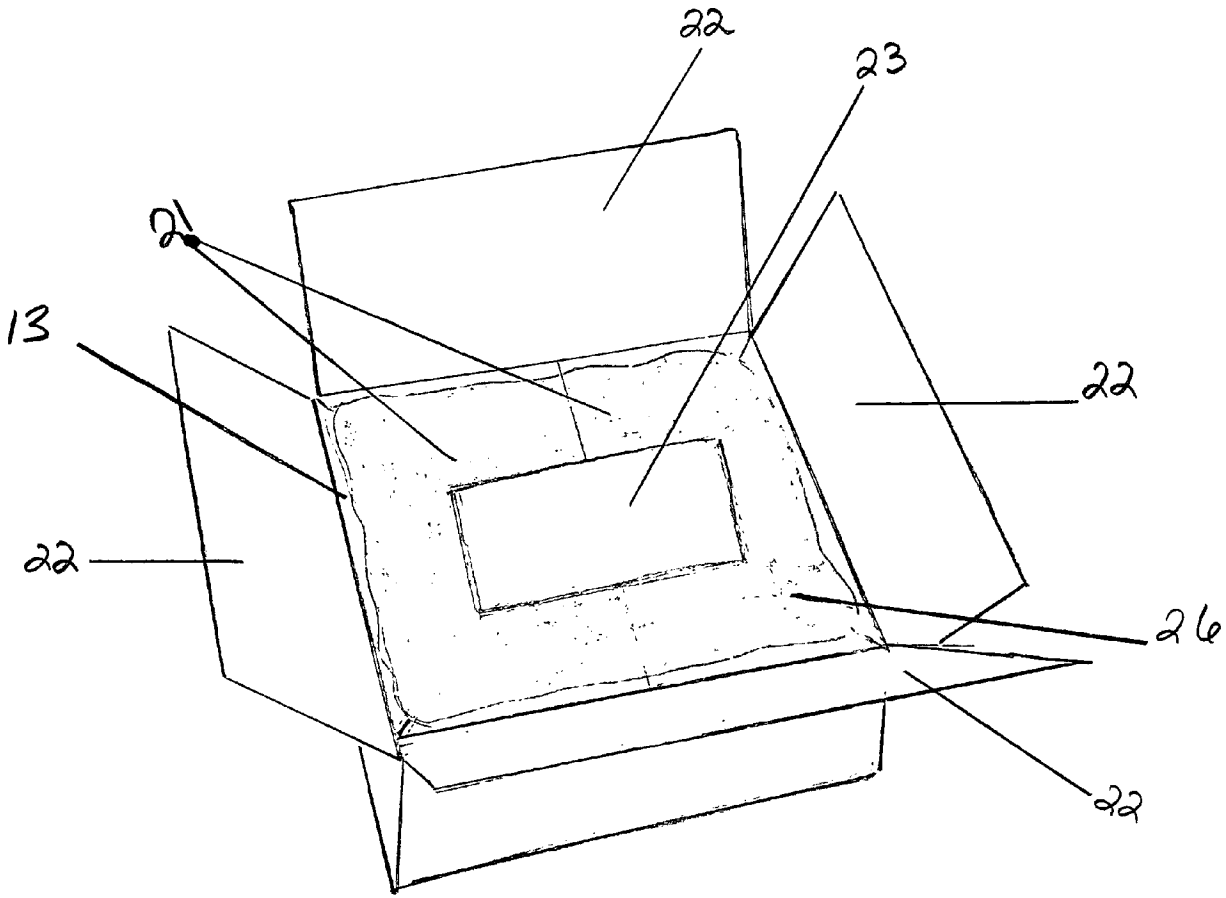
FIG. 8 is a plan view of the inside of the box in FIG. 1 with bottom closed and an article placed in the bottom of the box.
Figure 9:
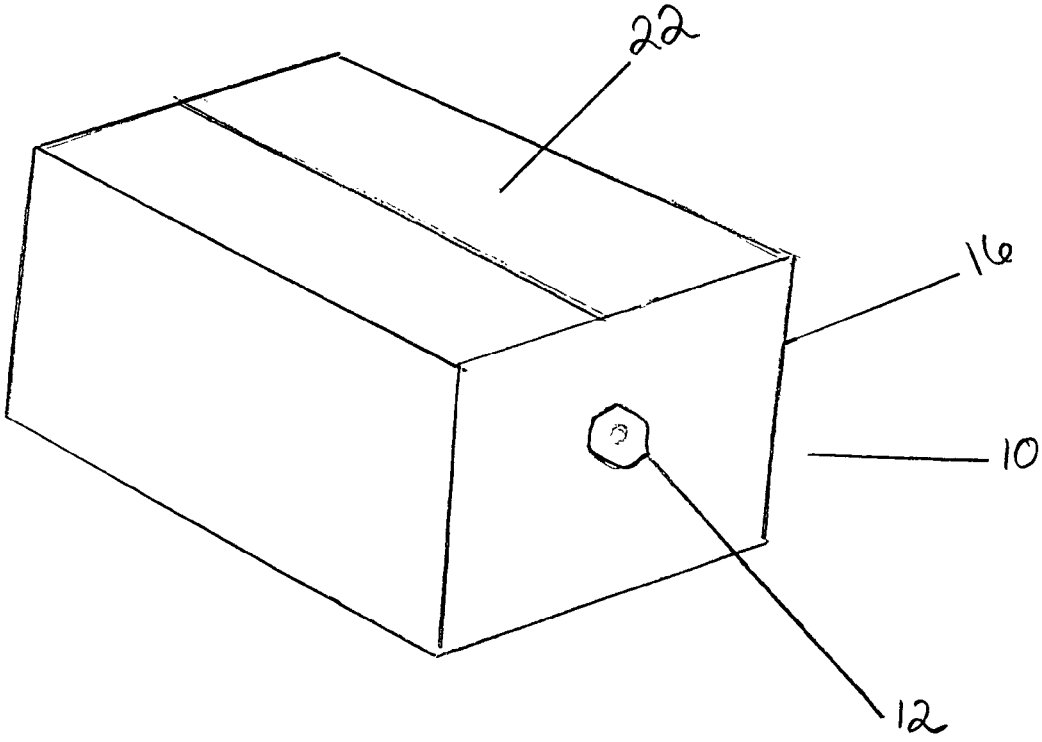
FIG. 9 is a plan view of the box in FIG. 1 with both the bottom and top flaps closed.
Figure 10:
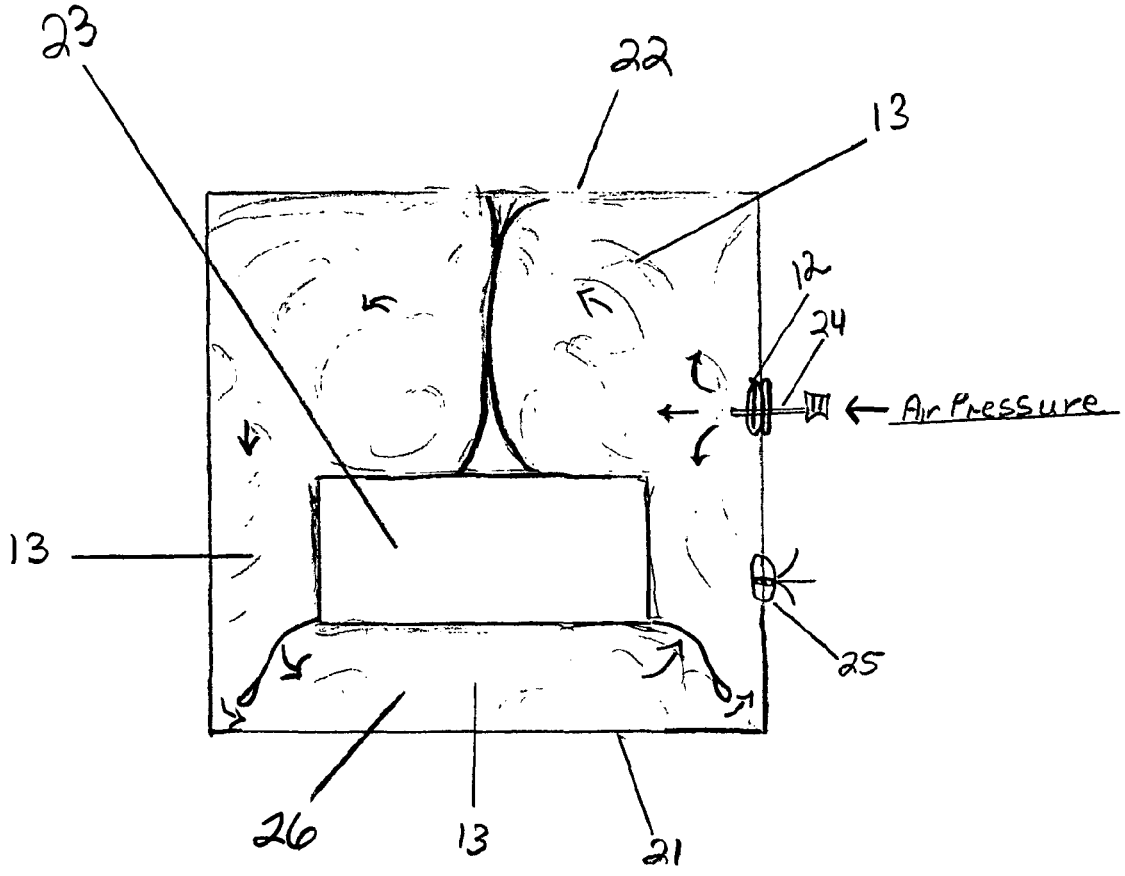
FIG. 10 is a side transparent view of the inside of the box in FIG. 1 that has both top and bottom flaps closed and is being inflated with a needle through the air valve on the side of the box and it also exhibits a bleeder valve as an option.

A plan view of the box 10 is shown in FIG. 7 with the top flaps 22 of the box 10 opened. FIG. 8 is an inside plan view of the box with an article 23 placed on the bottom of the box 10. FIG. 9 shows a plan view of the box 10 with tops flaps 22 closed and the box 10 is ready for inflation of the cushion prior to shipment. And FIG. 10 is a transparent side view of the box illustrating what is occurring inside of the box during inflation. The bottom and sides of the inflatable cushion starts to fill with air giving support of the article 23 from all side. The inflatable cushion 13 will inflate to provide protection on the bottom, top and sides. The needle 24 as shown will penetrate the valve 12 and cushion allowing air under pressure to enter. Also illustrated in FIG. 10 is an optional bleed valve 25 which will allow for the air to escape if the device is over filled with air.

This detailed description as provided allows for a marked advance in the art of inflatable packaging. The steps are as follows:

e) closing the bottom flaps of the box;

f) placing the article to be shipped into the box;

g) closing the top flaps of the box;

h) filling the box with air through the valve.

The simplicity and novelty of the invention is unmatched in the art. This device could be easily automated. For example an assembly line could have boxes coming down a conveyor belt with the bottom of the boxes closed leaving the top open. Then the users would only have to place the articles to be shipped inside of the box through automated or manual means. Then the box would continue down the conveyor belt to an air filling station where the an automated or manual means could be used to inflate the box to the desired pressure. This invention is going to save the packaging industry millions of dollars in shipping time, weight, and labor.

To further explain the inflatable box is that it comprises an inflatable box made up of a rigid material or the like, with an attached inner inflatable cushion with a bottom that is attached to the inside walls of the box which can be inflated through a valve, where the box includes bottom closing flaps (top and bottom), the inflatable cushion covers the inside walls and the bottom of the box; and a valve which connects the outside of the box through a hollow lumen to the inside of the cushion allowing air to pass through from the outside of the box to the inside of the inflatable cushion. This box allows for a method of packaging where an article can be packaged using an inflatable box comprising an outer rigid cardboard material or the like with bottom and top flaps, and a flexible inflatable cushion that is attached to the inside walls of the box which can be inflated through a valve, wherein the method to inflate the box comprises the steps as previously described. Of course the inflatable box can be filled with air or any other gas the user decides to use.

The invention has been described in detail with particular reference to a preferred embodiment and the operation thereof and it is understood that variations, modifications, and substitution of equivalent means can be effected and still remain within the spirit and scope of the invention. And all such modifications and variations are to be included within the scope of the invention as defined in the appended claims.

That which is claimed is:

1. A package that cushions items being shipped, comprising:

a box having a hollow interior defined by a top wall, a bottom wall, and sidewalls interconnecting said top and bottom walls;

an inflatable bladder affixed within said hollow interior of said box, said inflatable bladder including a bottom portion and side portions extending from said bottom portion to form an interior space having an open top when in a first deflated position, said side portions being substantially normal to said bottom portion and extending substantially along a length of said sidewalls of said box in said first deflated position;

an opening formed in said box;

a normally closed valve disposed in sealing engagement with said opening;

said normally closed valve having an inlet port external to said box;

said inlet port adapted to be connected to a source of gaseous fluid under pressure;

said inlet port being in fluid communication with said inflatable bladder so that said inflatable bladder is inflated when said source of gaseous fluid under pressure is connected to said inlet port; and said inflatable bladder having a second inflated position when said box is in a closed position, said side portions of said inflated bladder engulf said item being shipped by filling in said open top when in said second inflated position.

2. The package of claim 1, further comprising:

said box being made of a rigid material.

3. The package of claim 1, further comprising:

said box being made of a semi-rigid material.

4. The package of claim 1, further comprising:

a hand pump in fluid connection with said inflatable bladder.

5. The package of claim 1, further comprising:

said inflatable bladder further comprises a bleed valve disposed in fluid communication with said inflatable bladder.

* * * * *